US008689392B2

(12) United States Patent
Kawamura

(10) Patent No.: US 8,689,392 B2
(45) Date of Patent: Apr. 8, 2014

(54) MOP DUST SUCTION DEVICE

(76) Inventor: Keiichi Kawamura, Aichi (JP)

( * ) Notice: Subject to any disclaimer, the term of this patent is extended or adjusted under 35 U.S.C. 154(b) by 0 days.

(21) Appl. No.: 13/643,520

(22) PCT Filed: Apr. 20, 2011

(86) PCT No.: PCT/JP2011/059766

§ 371 (c)(1),
(2), (4) Date: Oct. 25, 2012

(87) PCT Pub. No.: WO2011/136112

PCT Pub. Date: Nov. 3, 2011

(65) Prior Publication Data

US 2013/0036572 A1 Feb. 14, 2013

(30) Foreign Application Priority Data

Apr. 26, 2010 (JP) ..... 2010-101551

(51) Int. Cl.
*A47L 5/38* (2006.01)
*A47L 9/02* (2006.01)

(52) U.S. Cl.
USPC ..... 15/310; 15/246.2; 15/327.1; 15/394; 15/403; 15/415.1

(58) Field of Classification Search
USPC ..... 15/246.2, 310, 327.1, 393, 394, 403, 15/415.1
IPC ..... A47L 5/38,9/02
See application file for complete search history.

(56) References Cited

U.S. PATENT DOCUMENTS 7,024,723 B2 * 4/2006 Vandenbelt et al. ..... 15/310

FOREIGN PATENT DOCUMENTS

| | | | |
|---|---|---|---|
| JP | 9173264 | A | 7/1997 |
| JP | 2000312661 | A | 11/2000 |
| JP | 2003153830 | A | 5/2003 |
| JP | 2003515373 | A | 5/2003 |
| JP | 2004-242731 | A | 9/2004 |
| JP | 2006340826 | A | 12/2006 |
| WO | WO2009038291 | A1 | 3/2009 |

OTHER PUBLICATIONS

Form PCT/ISA/210 (International Search Report) for PCT/JP2011/059766, mailed Jul. 19, 2011.
U.S. Publication No. 2001/0002498 A1 to Lindquist et al., published Jun. 7, 2001.

* cited by examiner

*Primary Examiner* — David Redding
(74) *Attorney, Agent, or Firm* — Koppel, Patrick, Heybl & Philpott

(57) ABSTRACT

[Object]
An object is to easily suction dust/dirt on a cleaning portion of a mop as need arises without scattering the dust/dirt adhering to the mop when cleaning a floor with a vacuum cleaner while cleaning with the mop.

[Solution]
A mopstick (4) is inserted through an opening (13) on a cylindrical cleaning unit (6) of a mop dust suction device (3), which includes a hose coupling unit (7) detachably attached to a connection portion of a hose of a vacuum cleaner; a cleaning portion (5) of the mop is drawn into the cylindrical cleaning unit (6); the cleaning portion (5) of the mop is rotated in an arrow (B12) direction while the cleaning portion (5) of the mop is moved repeatedly in an arrow (A11) direction; and the dust/dirt adhering to the mop is easily suctioned and removed by suction force of a vacuum cleaner main body (1).

6 Claims, 10 Drawing Sheets

MOP DUST SUCTION DEVICE

TECHNICAL FIELD

The present invention relates to a suction device, which can remove dust adhering to a mop for cleaning a flat surface, a complexly uneven surface, and a surface made of a soft material and which is detachably attached to a hose unit of a vacuum cleaner.

BACKGROUND ART

A mop using extrafine fiber of resin is used as a tool for cleaning a place with a complexly uneven surface, a place which is too narrow for a suction unit of a vacuum cleaner to get in, and a place where dust sticks to a surface to be cleaned.

By cleaning with the mop, a considerable amount of dust adheres to the extrafine fiber of the mop. When cleaning is continued in such a state, there is concern that the adhering dust is scattered from the mop as well as that the surface to be cleaned is scratched because the extrafine fiber of the mop collects not only dust but also something hard such as sand and metal fragments while cleaning with the mop. In order to suppress the dust from being scattered from the mop and suppress the surface to be cleaned from being scratched, it is necessary, in each case where the dust, sand, metal fragments, and the like have adhered to the mop, to suction them with an equipment having a suction function such as a vacuum cleaner.

As a way to suction the dust on the mop, a vacuum cleaner has been devised in which a cleaning portion of the mop can be housed in a vacuum cleaner main body and, while the cleaning portion is housed in the vacuum cleaner main body, dust and dirt adhering to the cleaning portion can be collected into a dust collection bag by means of suction force of the vacuum cleaner and also floor cleaning can be performed. Such a vacuum cleaner makes it possible to concurrently cleaning a normal floor and a wide range other than the floor such as a table, a shelf, audio furniture, a TV set, and the like. Moreover, since the dust and dirt adhering to the cleaning portion is collected into the dust collection bag by means of the suction force of a motor blower in a state where the cleaning portion is housed in the vacuum cleaner main body, it is possible to always clean the cleaning portion and keep the cleaning portion in a sanitary condition.

PRIOR ART DOCUMENTS

Patent Documents

JPH09-173264A
JP 2000-312661A
JP 2003-153830A
JP 2006-340826A

SUMMARY OF THE INVENTION

Problems to be Solved by the Invention

There are following problems in the suction device that suctions the dust and dirt adhering the extrafine fiber of the cleaning portion of the mop, which can be used to clean a place with a complexly uneven surface where a vacuum cleaner cannot be used, a place which is too narrow for a suction unit of the vacuum cleaner to get in, and a place where the dust sticks to a surface to be cleaned, in order to suppress the dust and dirt, which has adhered to the mop while cleaning, from being scattered and suppress a body to be cleaned from being scratched by the sand, metal fragments, and the like adhering to the cleaning portion of the mop.

Specifically, there is a problem in which, since the suction portion, into which the mop is inserted and which suctions the dust, is provided at the vacuum cleaner main body, the vacuum cleaner main body becomes larger and, thus, reduction in size and weight required for a vacuum cleaner is affected.

Moreover, since the extrafine fiber of the cleaning portion of the mop is soft and voluminous, it is difficult to insert the cleaning portion into the suction portion, which suctions the dust and dirt on the mop, provided in the vacuum cleaner main body. That causes the once-removed dust and dirt to be scattered.

Accordingly, a mop dust suction device has been demanded which can suction the dust and dirt adhering to the cleaning portion of the mop without scattering the dust and dirt and can be attached to the vacuum cleaner without causing the vacuum cleaner main body to become larger.

Means for Solving the Problems

The present invention provides a mop dust suction device that includes a coupling unit which can be easily connected and attached to a midway of a suction hose for floor cleaning connected to a vacuum cleaner main body and makes it possible to secure an intake port exclusively for mop cleaning without affecting reduction in size and weight of the vacuum cleaner main body.

The present invention provides the mop dust suction device that includes a cylindrical cleaning unit in order to suppress dust adhering to a mop from being scattered when the dust is suctioned by moving a portion of the mop, to which the dust has adhered, back and forth over the intake port exclusively for mop cleaning.

When the cleaning portion of the mop, which is soft and voluminous, is inserted into the cylindrical cleaning unit, a mopstick is inserted first and the cleaning portion of the mop is drawn into the cylindrical cleaning unit together with the mopstick. The dust and dirt adhering to the cleaning portion of the mop is thereby suppressed from being scattered. The present invention provides the mop dust suction device that includes an opening through which the mopstick is inserted from a side wall of the cylindrical cleaning unit while the mopstick is kept held in hand.

Effects of the Invention

A mop dust suction device 3 of the present invention can be coupled and connected to a midway of a hose 2 of a vacuum cleaner main body 1. Therefore, a suction port capable of suctioning, as need arises, dust and dirt adhering to a cleaning portion of a mop is secured, which makes it possible to perform a cleaning with the mop while cleaning a floor surface without a need to detach a suction device for cleaning a floor surface. As a result, it is possible to improve cleaning workability dramatically, as well as to suppress the dust and dirt adhering to the cleaning portion of the mop from being scattered and suppress a surface to be cleaned from being scratched by sand and metal fragments adhering to the cleaning portion of the mop.

EXPLANATION OF REFERENCE NUMERALS

1 . . . vacuum cleaner main body,
2 . . . hose,
3 . . . mop dust suction device,
4 . . . mopstick,
5 . . . cleaning portion of mop,
6 . . . cylindrical cleaning unit,
7 . . . hose coupling unit,
8 . . . suction port of cylindrical cleaning unit,
9 . . . suction port of hose coupling unit,
10 . . . state where suction port is communicated,
11 . . . arrow A,
12 . . . arrow B,
13 . . . opening

MODE FOR CARRYING OUT THE INVENTION

Embodiment 1

Figure 1:
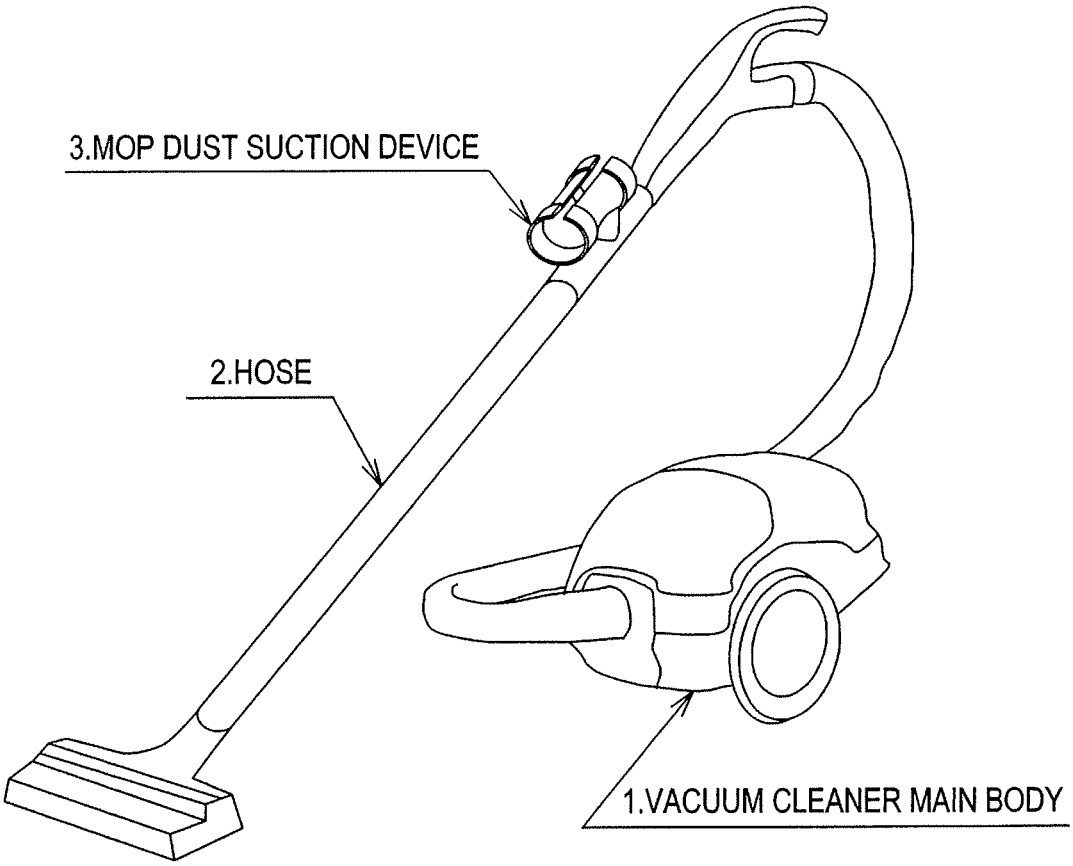
FIG. 1 shows a state where a mop dust suction device 3 is attached to a hose 2 of a vacuum cleaner main body 1.
Figure 2:
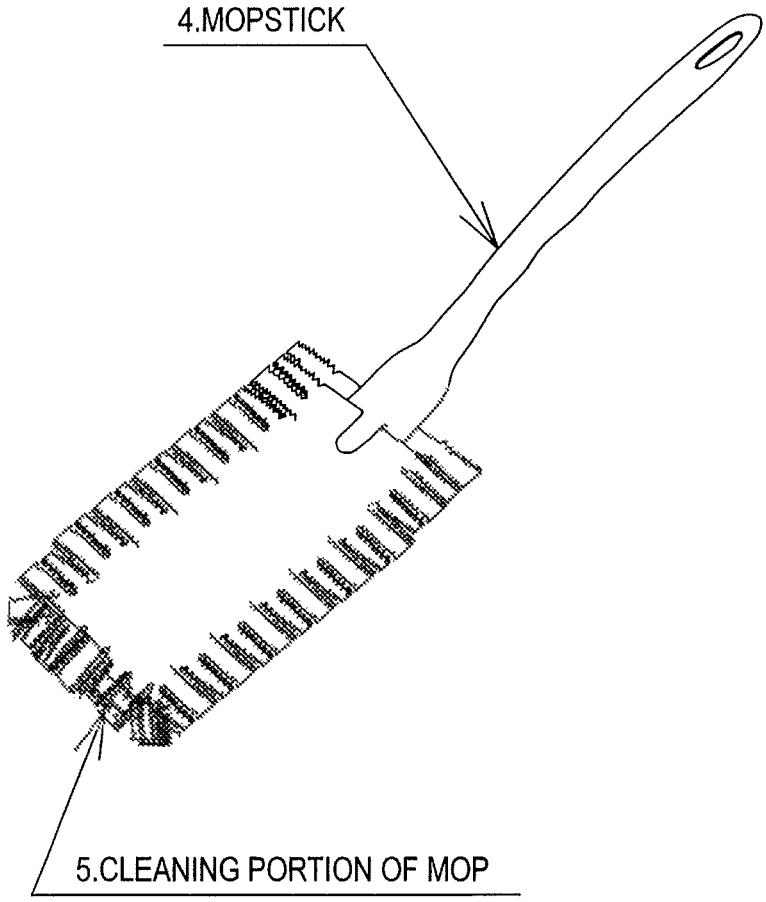
FIG. 2 is a view illustrating a mop.

FIG. 1 shows an embodiment of the present invention, and illustrates a state where a mop dust suction device 3 is attached to a hose 2 of a vacuum cleaner 1.

Figure 3:
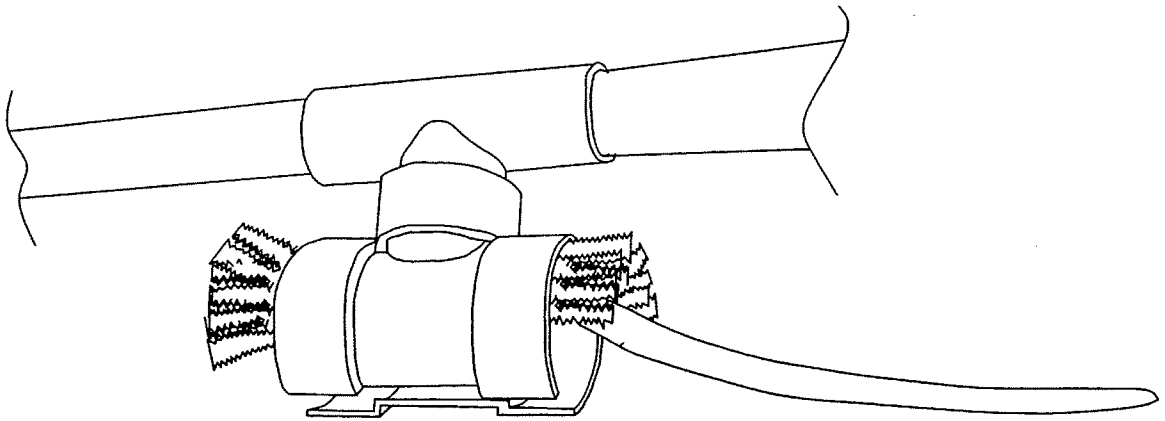
FIG. 3 is a view illustrating a state where the mop is inserted into the mop dust suction device 3.

FIG. 3 shows the embodiment of the present invention. A mop is inserted into a cylindrical cleaning unit 6 of the mop dust suction device 3 attached to a vacuum cleaner main body 1 which is in a suction state. Thereby it becomes possible to carry around the mop while cleaning a floor surface with the vacuum cleaner, and thus to clean a place with an uneven surface such as a desk surface, furniture, furnishing goods, ornamentation, leaves of a foliage plant, and the like with the mop in hand whenever necessary.

Figure 4:
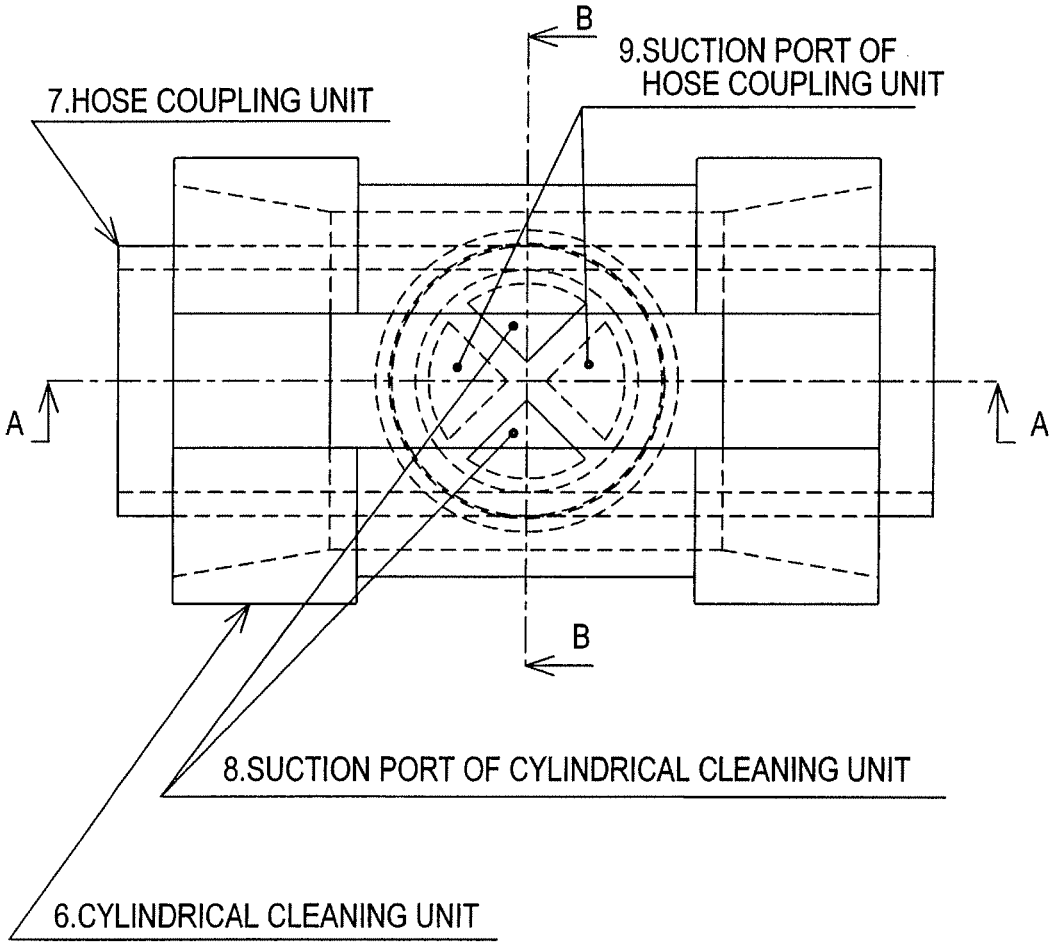
FIG. 4 is a top view of the mop dust suction device 3. A cylindrical cleaning unit 6 and a hose coupling unit 7 are parallel to each other.

FIG. 4 is a top view of the mop dust suction device 3. In a state where the cylindrical cleaning unit 6 of the mop dust suction device 3 is parallel to a hose coupling unit 7, suction cannot be performed because a suction port 8 of the cylindrical cleaning unit and a suction port 9 of the hose coupling unit are out of alignment by 90 degrees.

Figure 5:
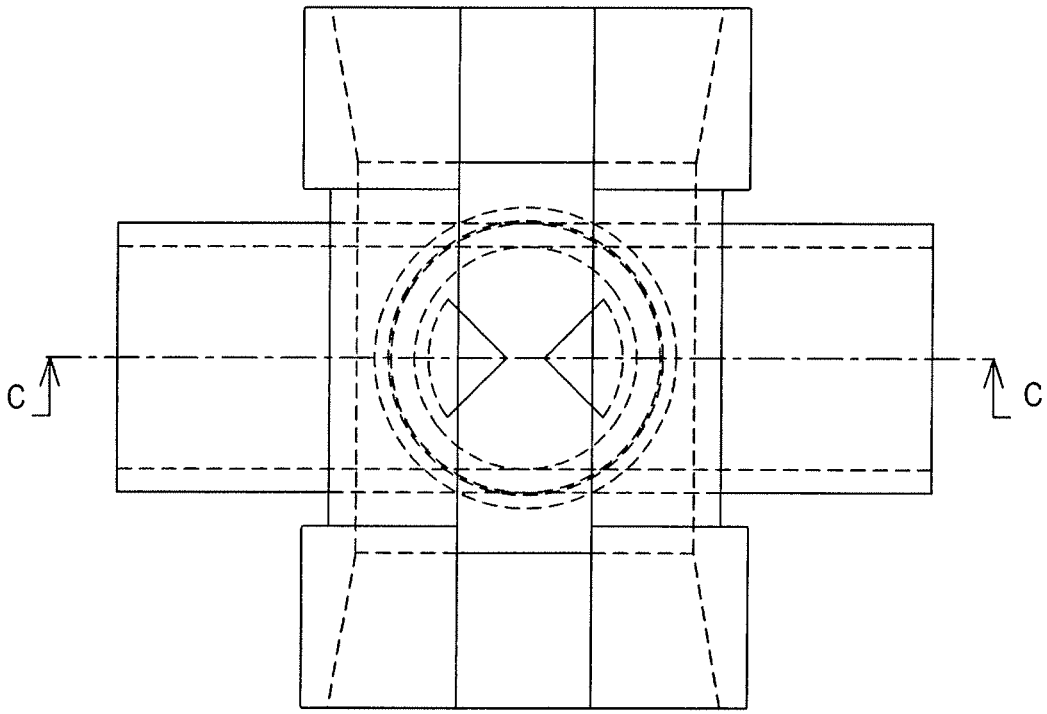
FIG. 5 is a top view of the mop dust suction device 3. The cylindrical cleaning unit 6 is rotated 90 degrees with respect to the hose coupling unit 7.
Figure 6:
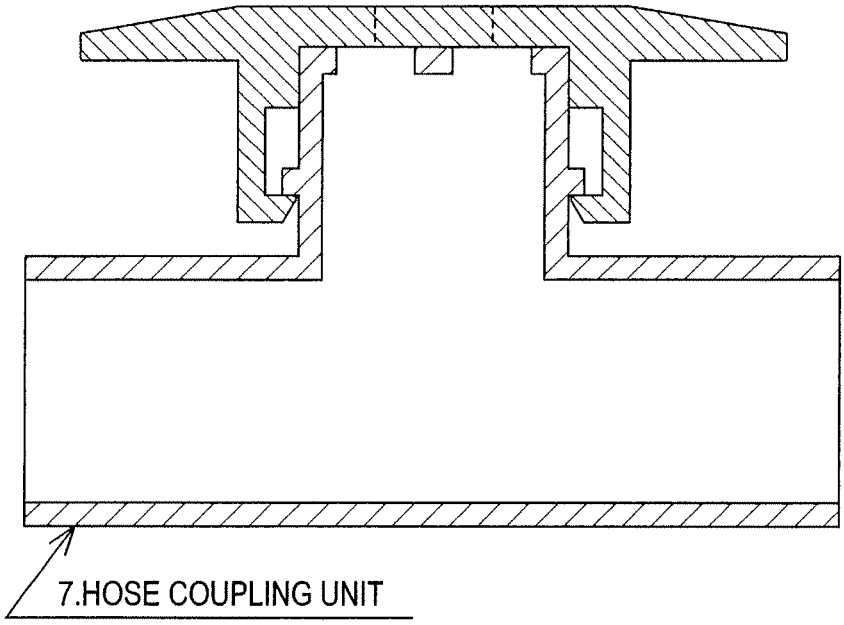
FIG. 6 is an A-A sectional view of FIG. 4.
Figure 7:
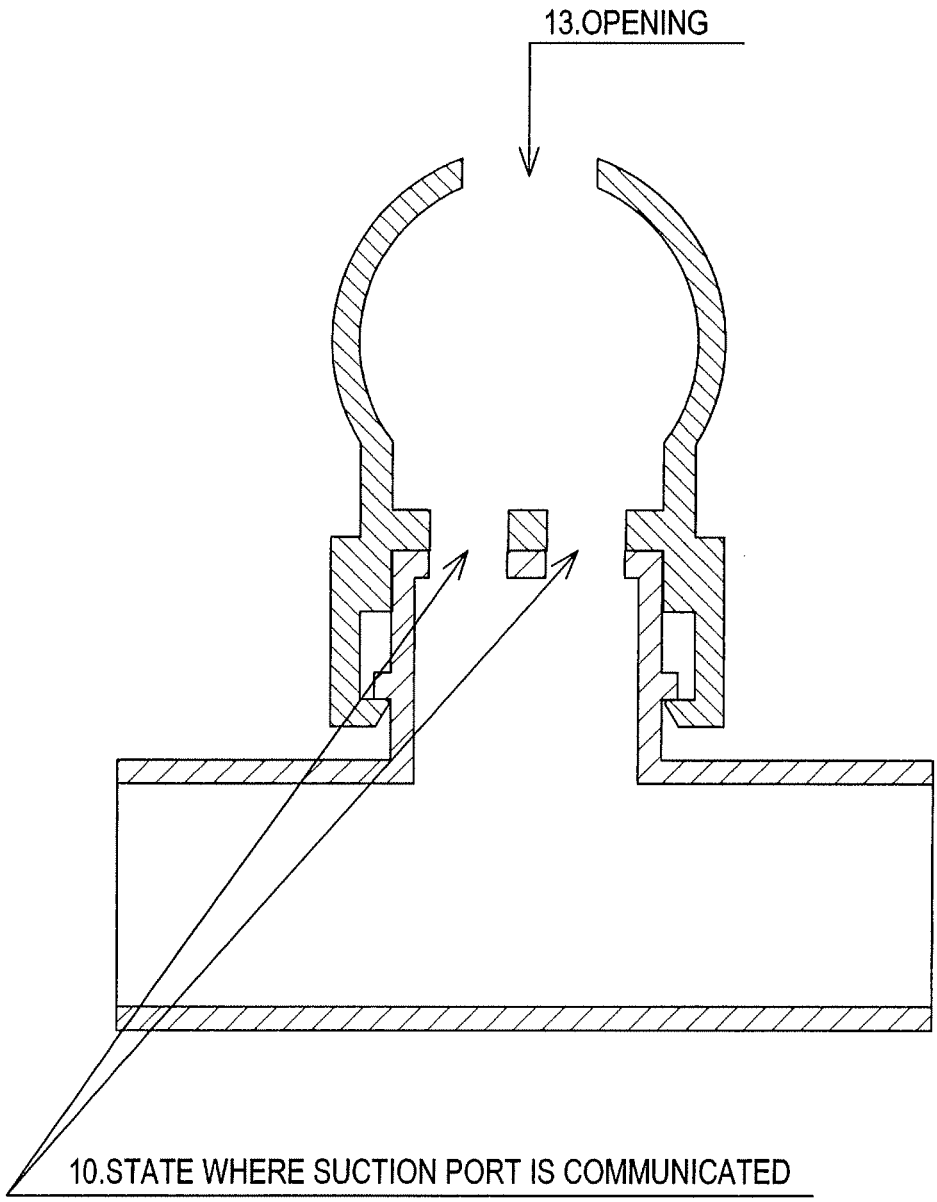
FIG. 7 is a C-C sectional view of FIG. 5.
Figure 8:
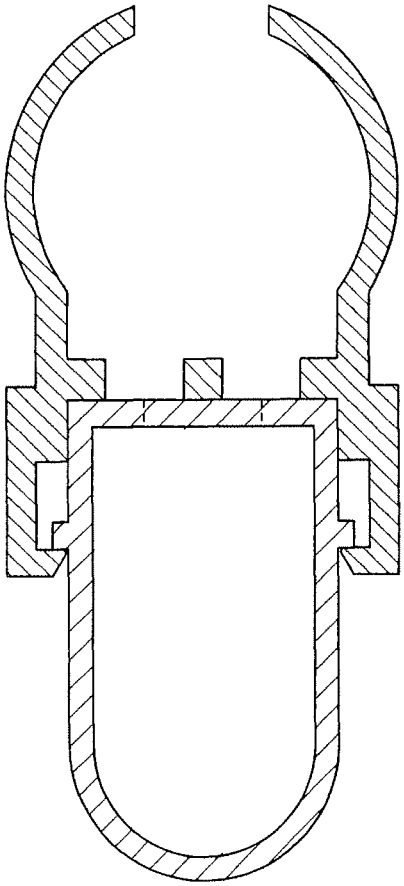
FIG. 8 is a B-B sectional view of FIG. 4.

FIG. 5 is a top view of the mop dust suction device 3. In a state where the cylindrical cleaning unit 6 of the mop dust suction device 3 is rotated 90 degrees with respect to the hose coupling unit 7, suction can be performed by means of suction power of the vacuum cleaner main body 1 because the suction port 8 of the cylindrical cleaning unit and the suction port 9 of the hose coupling unit are in a communicating state. By changing an angle of the cylindrical cleaning unit 6 of the mop dust suction device 3 with respect to the hose coupling unit 7 between 0 to 90 degrees, an overlapping amount between the suction port 8 of the cylindrical cleaning unit and the suction port 9 of the hose coupling unit can be changed, to thereby enable adjustment of the suction force.

Figure 9:
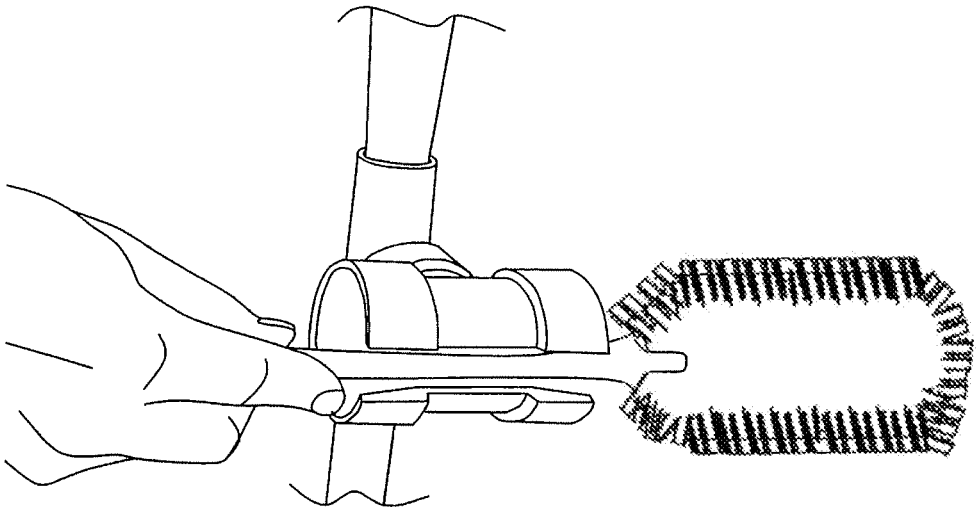
FIG. 9 is a view illustrating a state where a mopstick 4 is inserted into the cylindrical cleaning unit 6 of the mop dust suction device 3 from an opening 13, and the cylindrical cleaning unit 6 is rotated 90 degrees with respect to the hose coupling unit 7.

FIG. 9 is a view illustrating a state where a mopstick of a mop to which dust and dirt has adhered after cleaning a place with a complexly uneven surface is inserted through an opening 13 provided on the mop dust suction device 3, and the cylindrical cleaning unit 6 is rotated 90 degrees with respect to the hose coupling unit 7.

Figure 10:
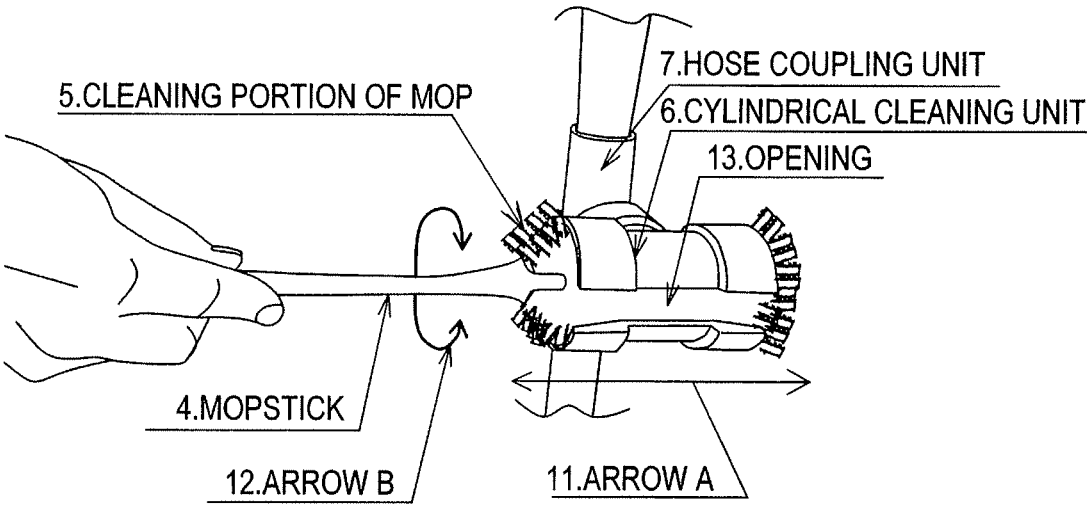
FIG. 10 is a view illustrating a state where the mopstick 4 is inserted into the cylindrical cleaning unit 6 of the mop dust suction device 3 from the opening 13, the cylindrical cleaning unit 6 is rotated 90 degrees with respect to the hose coupling unit 7, a cleaning portion 5 of the mop is drawn into the cylindrical cleaning unit 6, and dust and dirt on the cleaning portion 5 of the mop is being suctioned from a suction port 8 of the cylindrical cleaning unit.

FIG. 10 is a view illustrating a state where the mopstick 4 of the mop to which dust and dirt has adhered after cleaning a place with a complexly uneven surface is inserted through the opening 13 provided on the mop dust suction device 3, the cylindrical cleaning unit 6 is rotated 90 degrees with respect to the hose coupling unit 7, thereby the suction port 8 of the cylindrical cleaning unit and the suction port 9 of the hose coupling unit are communicated with each other, and a cleaning portion 5 of the mop is drawn into the cylindrical cleaning unit 6. With this state, by rotating the mop in a direction of an arrow B 12 while moving the mop back and forth in a direction of an arrow A 11, the dust and dirt on the cleaning portion of the mop can be suctioned without being scattered.

INDUSTRIAL APPLICABILITY

The present invention enables more reliable removal of dust not only at home but also in a clean room and the like at a plant manufacturing precision products. Moreover, by providing the suction port of the cylindrical cleaning unit with an antistatic function to temporarily remove static electricity, the dust adhering to the cleaning portion of the mop can be removed more rapidly. Furthermore, by providing a groove inside the cylindrical cleaning unit 3 toward the suction port 8 of the cylindrical cleaning unit, an area of the suction port becomes larger and a time to remove the dust adhering to the cleaning portion of the mop can be shortened. Also, static electricity is generated by friction with the fiber of the cleaning portion of the mop, and thereby capability of suctioning the dust is enhanced.

The invention claimed is:

1. A suction device to suction mop dust capable of being coupled to a hose connected to a vacuum cleaner main body, said suction device comprising:

a hose coupling unit attachable to a midway of said hose;

a cleaning unit having a cylindrical configuration and being attached to said hose coupling unit so as to be rotatable with respect to said hose coupling unit;

wherein each of said hose coupling unit and said cleaning unit has a suction port, wherein an overlapping amount between said suction port of said cleaning unit and said suction port of said hose coupling unit is changed by a rotation of the cleaning unit with respect to said hose coupling unit, and wherein said overlapping amount between said suction port of said cleaning unit and said suction port of said hose coupling unit is gradually increased as said cleaning unit is rotated from a position where said cleaning unit is approximately parallel to said hose coupling unit to a position where said cleaning unit forms an angle of approximately 90 degrees with respect to said hose coupling unit.

2. The suction device according to claim 1, wherein said suction port of said cleaning unit and said suction port of said hose coupling unit are positioned to be mutually shifted by approximately 90 degrees in a state where said cleaning unit is approximately parallel to said hose coupling unit.

3. The suction device according to claim 2, wherein said suction port of said cleaning unit and said suction port of said hose coupling unit do not communicate with each other in the state where the cleaning unit is approximately parallel to the hose coupling unit.

4. The suction device according to claim 1, wherein each of said hose coupling unit and said cleaning unit includes a rotary slidable portion to allow rotation of said cleaning unit with respect to said hose coupling unit.

5. The suction device according to claim 1, wherein a peripheral wall of said cleaning unit includes a hole communicating with said hose coupling unit only in a region, which is connected to said hose coupling unit, of said peripheral wall.

6. A vacuum cleaner provided with a suction device to suction mop dust, said suction device being capable of being coupled to a hose of said vacuum cleaner and comprising:

a hose coupling unit attachable to a midway of said hose; and a cleaning unit having a cylindrical configuration and being attached to said hose coupling unit so as to be rotatable with respect to said hose coupling unit, wherein each of said hose coupling unit and said cleaning unit has a suction port, wherein an overlapping amount between said suction port of said cleaning unit and said suction port of said hose coupling unit is changed by a rotation of said cleaning unit with respect to said hose coupling unit, and wherein said overlapping amount between said suction port of said cleaning unit and said suction port of said hose coupling unit is gradually increased as said cleaning unit is rotated from a position where said cleaning unit is approximately parallel to said hose coupling unit to a position where said cleaning unit forms an angle of approximately 90 degrees with respect to said hose coupling unit.

* * * * *